United States Patent [19]

Misevich et al.

[11] Patent Number: 4,956,927

[45] Date of Patent: Sep. 18, 1990

[54] MONOLITHIC OUTSOLE

[75] Inventors: Kenneth W. Misevich, Griswold, Conn.; Thomas E. Mintel, Rahway, N.J.

[73] Assignee: Colgate-Palmolive Company, Piscataway, N.J.

[21] Appl. No.: 286,803

[22] Filed: Dec. 20, 1988

[51] Int. Cl.[5] ..... A43B 13/18; A43B 13/04; A43B 3/14

[52] U.S. Cl. ..... 36/32 R; 36/28; 36/25 R; 36/11

[58] Field of Search ..... 36/30 R, 32 R, 25 R, 36/28, 12, 91, 104, 102, 11.5, 24.5, 14, 11, 103, 87, 15, 13

[56] References Cited

U.S. PATENT DOCUMENTS

| | | | |
|---|---|---|---|
| 242,328 | 5/1881 | Keith | 36/18 |
| 294,174 | 2/1884 | Williams | 36/14 |
| 376,411 | 1/1888 | Lion et al. | 36/22 R |
| 1,115,922 | 11/1914 | Furber | 36/25 R |
| 1,167,885 | 1/1916 | Carll | 36/32 R |
| 3,890,725 | 6/1975 | Lea et al. | 36/11.5 |
| 4,262,435 | 4/1981 | Block et al. | 36/25 R |
| 4,525,940 | 7/1985 | Mochizuki | 36/11.5 |
| 4,551,929 | 11/1985 | Paris | 36/14 |
| 4,561,195 | 12/1985 | Onoda et al. | 36/30 R |
| 4,794,706 | 1/1989 | Puckhaber et al. | 36/91 |

FOREIGN PATENT DOCUMENTS

| | | | |
|---|---|---|---|
| 0215995 | 4/1987 | European Pat. Off. | 36/29 |
| 3636290 | 4/1987 | Fed. Rep. of Germany | 36/28 |
| 779412 | 7/1957 | United Kingdom | 36/25 R |

*Primary Examiner*—Steven N. Meyers

*Attorney, Agent, or Firm*—Richard J. Ancel; Robert C. Sullivan; Murray M. Grill

[57] ABSTRACT

An outsole construction for a shoe which provides all midsole and outsole functions with a single homogeneous moldable material thorough geometry alone is disclosed. The invention employs cut-out geometry for engineering various characteristics into an outsole of a uniform, monolithic material. Such characteristics are obtained by removing material or reinforcing the material so that it functions as if it had different densities. The invention is based on the principle of minimum sufficient thickness in order to maintain the foot as close to the ground as possible. Energy absorption/cushioning is achieved in the invention by the following features: (1) a series of transverse slots along the lateral border to provide cushion conformability to the lower foot column; (2) an array of compression columns or holes in the heel region to accept the known pressure distributions; (3) an array of small holes in the ball region to add both cushioning and flexibility; (4) a raised heel cup to constrain the heel fat pad expansion during impact and enhance the natural shock absorbing characteristics of the foot; and (5) relief of the rear lateral heel border to dynamically smooth and cushion initial heel strike. The outsole construction of the present invention may be advantageously employed to provide anchor sites for a transverse support sling having straps which are carried over the top of the midfoot and allowed to fan out with attachment to the outsole under the upper and lower columns of the foot. A further embodiment of the invention provides reference anchor points in the outsole for attachment of the shoe upper, thus eliminating the need for a shoe last in manufacturing.

33 Claims, 2 Drawing Sheets

MONOLITHIC OUTSOLE

BACKGROUND AND SUMMARY OF THE INVENTION

The present invention relates to an outsole construction for a shoe. More particularly, the present invention relates to a construction which provides all midsole and outsole functions for a shoe with a single homogeneous moldable material through geometry alone. The present invention employs cut-out geometry for engineering various characteristics into an outsole of a uniform, monolithic material. These characteristics are obtained by removing material or reinforcing the material so that it functions as if it had different densities.

In an attempt to understand the foot as a system, the various parameters which affect the function of the foot have been studied, particularly with regard to a weight bearing foot. The practical need for such knowledge lies in the fact that a true structural model of the foot is capable of providing a prediction of gait and the effect of a shoe on gait. By knowing, in advance, how a shoe would affect the performance of an athlete, for example, optimum shoes could be designed without the usual "cut and try" method of standard shoe development.

The traditional model of the foot provides for a one column, two-axis model which maintains that the foot under load is a rigid structure with a talocrural (ankle) axis and an apparent subtalar axis. The front of the foot is relatively rigid, but with only a multitude of small bone movements about the midtarses axes. The average direction of the effective axis under the ankle, called the subtalar axis, is said to be 42 degrees vertical and 16 degrees horizontal to the midline of the body, as measured by Inman, V.T., *The Joints of the Ankle,* The Williams & Wilkins Co., Baltimore, 1976. However, this theory does not hold up with regard to a weight bearing or loaded foot since, if the force due to body weight were to act on the single traditional subtalar axis, the foot would collapse mechanically.

It has now been determined that the foot is comprised of two columns and three axes. The lower, lateral column is basically a rigid base comprised of the Calcaneus, Cuboid, and the fourth and fifth metatarsals. The remainder of the foot, which is comprised of the navicular, the first, second and third cuneiforms and the first, second and third metatarsals, emanates from the talus at the talonavicular interface swinging in combination with the lower column inversion/eversion actions in what may be called the 'subtalar joint axis'. But this articulation of what is called the upper foot column is only secondary to the true foot mechanism. The primary mechanical loading interface is on the lower, lateral column at the rear of the talus onto the calcaneus, the posterior talocalcaneal facet.

It has also been determined that the foot operates differently under load than when it is passively manipulated such as a doctor would do in the office. This distinction helps to explain previous misconceptions as to how the foot works under load.

This new understanding has yielded a new structural model of the foot which has two separate columns, wrapped together with fascia, and three nearly orthogonal axes. The three axes are: (1) the talocrural (ankle) axis; (2) the talocalcaneal axis (formed at the facet between the talus and the calcaneus); and (3) the talonavicular axis (formed at the facet between the talus and the navicular bones).

There have been molded shoe outsoles in existence for many years but such constructions have been intended primarily to deal with problems of cushioning, tread and traction, and to mate with a lasted shoe upper and to be affixed thereto with adhesives and/or stitching. Such previous constructions have not been intended to provide an optimal base for the structural human foot. In particular, such constructions have not been based on a two column structural load frame as described herein. In addition, most previous outsole constructions are not designed to accommodate the change in function which occurs with only a small amount of wear of the edges on the bottom surface of the outsole.

By the present invention, there is provided an improved outsole construction in which, starting with a monolithic, thin, relatively soft, tough elastomer, all functions known to be needed by the structural foot model are addressed by addition or subtraction of material. The present invention is based on the principle of "minimum sufficient thickness" in order to maintain the foot as close to the ground as possible.

The outsole shape is what is commonly called "inflared" and has a detailed outline which is sufficient to support more than 90 percent of the foot population for a given foot length.

In the outsole construction of the present invention, energy absorption/cushioning is achieved by the following features:

1. A series of transverse slots along the lateral border to provide cushion conformability to the lower foot column.
2. An array of compression columns or holes in the heel region to accept the known pressure distributions.
3. An array of small holes in the ball region to add both cushioning and flexibility.
4. A raised heel cup to constrain the heel fat pad expansion during impact and advantageously enhance the natural shock absorbing characteristics of the foot.
5. Relief of the rear lateral heel border to dynamically smooth and cushion initial heel strike.

Static and dynamic stability in the present outsole construction are achieved by the following features:

1. Complete material support for the entire foot structure weight bearing points.
2. Minimum thickness and maximum flexibility to reduce any inversion/eversion torques including ankle sprains.
3. Heel cupping to constrain calcaneal movement.
4. Effective radial heel to reduce excessive eversion torques about the talocalcaneal axis, dynamically.
5. Subtle lateral border chock to reduce inversion rollover during standing.
6. Complete forefoot flexibility for firm footing on any pitched or irregular surface.
7. Firm toe base for gripping in balance and toe-off.

In the use of the outsole construction of the present invention, the "two column" foot has complete freedom of rotational motion because of transverse and longitudinal outsole flexibility. This is due to the thinness and softness of the outsole as well as relief of material to aid with this flexibility. In addition, exceptional durability is achieved by eliminating local wearing forces and rotations with the use of firm, flexible footing throughout the entire gait cycle. Also there are no materials which will degrade under repeated impacts and flexures.

The outsole construction of the present invention allows the three dimensional geometry of the shoe upper to be referenced precisely to the foot base or outsole at accurately placed anchor points without the use of a last.

The construction of the present invention also mechanically holds the shoe to the foot in the midfoot region where a support sling construction may be anchored.

Accordingly, it is a primary object of the present invention to provide all midsole and outsole functions for a shoe with a single homogeneous moldable material through geometry alone.

It is another object of the invention to provide anchor sites for a transverse support sling having straps which are carried over the top of the midfot and allowed to fan out with attachment to the outsole under the upper, medial column of the foot so as to optimally support the upper column when the foot is loaded.

It is a further object of the present invention to provide reference anchor points for upper attachment to eliminate the need for a shoe last in manufacturing.

It is another object of the invention to create a midsole/outsole construction which will maintain its functional performance for the reasonable life of the shoe.

DESCRIPTION OF THE PREFERRED EMBODIMENTS

Figure 1:
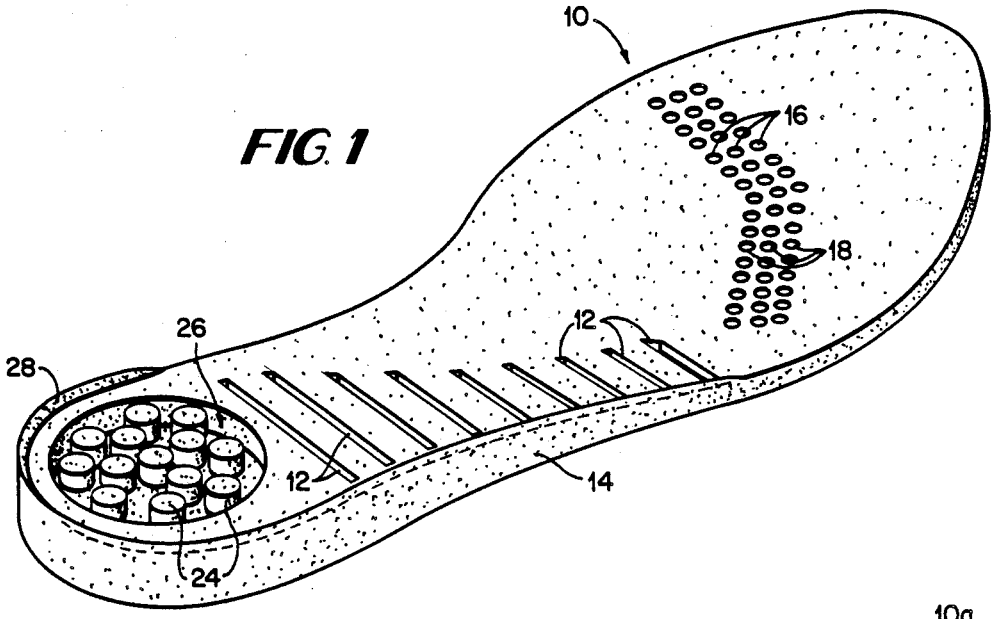
FIG. 1 is a perspective view of 1*n* outsole constructed in accordance with the present invention.

In the embodiment of the present invention as shown in FIGS. 1 through 4, there is provided an outsole 10 having a series of parallel slots 12 in the midfoot region located adjacent and extending transversely to the lateral border 14 of the outsole 10 so as to extend generally perpendicular to the longitudinal axis of the outsole 10. In one embodiment, the slot 12 of the greatest length is located near the heel region and the slots are of successively reduced length in the anterior direction toward the forefoot region.

Figure 2:
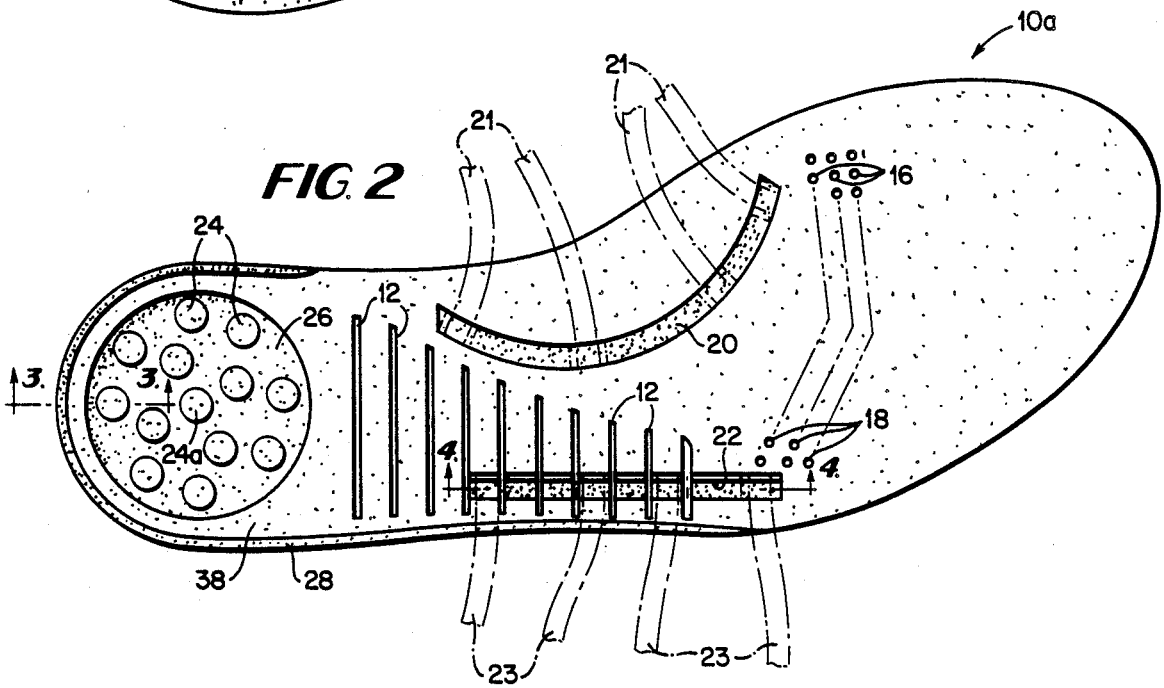
FIG. 2 is a plan view of an alternative embodiment of the outsole shown in FIG. 1.

An array of small holes 16, 18 is provided in the ball region of the outsole as shown in FIGS. 1 and 2. These holes 16, 18 are arranged in one embodiment so that the holes 16 on the medial side are in one or more rows parallel to the transverse metatarsal axis of the foot while the holes 18 on the lateral side are in one or more rows parallel to the oblique metatarsal axis of the foot. In another embodiment, the holes 16, 18 are arranged in one or more rows parallel to the transverse slots 12. The diameter of the holes 16, 18 is in the range of about $\frac{1}{8}$ to $\frac{1}{4}$ inch and the depth of the holes 16, 18 as well as the interval between adjacent holes 16, 18 will depend on the modulus of the outsole material.

In the embodiment as shown in FIG. 2, the upper surface of the outsole 10*a* is provided with a medial slot 20 and a lateral slot 22 in the midfoot region. These slots 20 and 22 are for the purpose of receiving respective medial 21 and lateral 23 sling straps which are mounted therein. In one embodiment, each of the slots 20, 22 is of sufficient depth to allow the respective slot to receive one end of the sling straps 21, 23 and maintain the connection of the straps at or below the level of the top of the outsole. The straps 21, 23 are of sufficient length so as to be capable of being extended up and over the midfoot of the wearer and to be releasably secured so that each medial strap 21 is releasably secured to a corresponding lateral strap 23 by means such as a Velcro fastener mounted on each of the straps 21, 23. Both slots 20, 22 are positioned in the upper surface of the outsole 10*a* so as to lie beneath the foot of the wearer.

In one embodiment, the medial slot 20 of the outsole 10*a* lies under the upper column of the foot in the form of an arcuate shape which lies beneath three anatomical points of the foot: (1) the posterior edge of the first metatarsal head; (2) the second or third cuneiform, preferably the third cuneiform; and (3) the medial side of the calcaneus. It is noted that a smooth arcuate shape is only relevant to a smooth groove in the outsole, whereas individual anchor points would align to the direction of the sling strap.

In one embodiment, the lateral slot 22 of the outsole 10*a* lies under the lower column of the foot throughout the length of the slot. This slot which is generally linear thus extends from the posterior edge of the fifth metatarsal head to a position proximate and adjacent the calcaneal-cuboid joint.

The specific shape, location and construction of the medial and lateral slots may be varied. It is also within the scope of the invention for an end portion of each of the sling straps to be adhered or otherwise attached to the upper surface of the outsole without the use of slots. The straps are each capable of serving as separate and independent lines of force to prevent the foot from everting and to provide the necessary support.

It has been found that the main pressure areas of the foot are in the areas of the lateral border, the metatarsal zone and the heel region. Thus by removing material from the outsole in any of these areas in particular, substantial benefits of the present invention are obtained to provide thereby a lower effective modulus and increased torsional flexibility. In these areas, it is desirable to reduce the effective modulus of the outsole to that of a running shoe. The material employed for the outsole of the present invention may be polyurethane or other similar outsole material known in the art. In one embodiment, the outsole material was polyurethane having a modulus of about 2000 to 4000 pounds per inch per inch.

The transverse slots 12 along the lateral border create a cushion effect under the lower column. The polyurethane materials often employed for the outsole are fairly stiff and thus the relief in the form of the slots 12 creates a lower effective modulus and also provides increased torsional flexibility. The interval between adjacent slots 12 as well as the dimensions of the slots 12, including the width and depth thereof, will depend on the modulus of the material and the amount of material removed should be sufficient to reduce the effective modulus in the region of the slots 12 to within the range of about 200 to 1000 pounds per inch per inch. In one embodiment, the slots 12 were uniformly ¼ inch deep, the width of the slots 12 was about 1/16 inch and the interval between adjacent slots 12 was about 5/16 inch. The length of the slots 12 is determined such that the slots 12 are positioned under the location at which the load is transferred from the lower column of the foot to the outsole 10, and with the slots 12 being located outside the region of the outsole 10 which lies directly under the arch of the foot. Thus the slots 12 do not extend medially beyond the arcuate medial slot 20.

Figure 3:
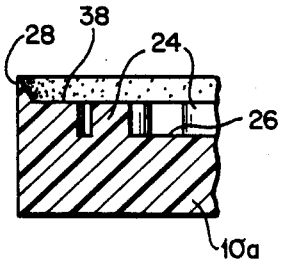
FIG. 3 is a cross sectional view of a portion of the heel region taken along line 3—3 of FIG. 2.
Figure 4:
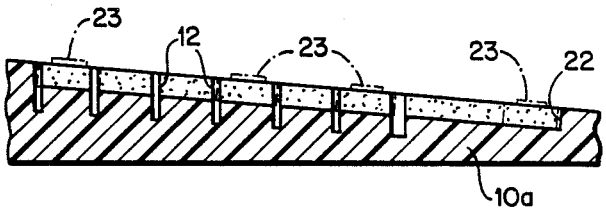
FIG. 4, is a cross sectional view of a portion of the midfoot region taken along line 4—4 of FIG. 2.

In the heel region, the outsole 10 of the present invention is provided with a plurality of compression columns 24 arranged within a cylindrical cavity 26, as shown in FIGS. 1 through 3. A lateral border chock 28 is positioned around the upper circumference of the heel and extends anteriorly along the lateral border to a position just anterior to the most anterior transverse slot 12. The primary purpose of the lateral border chock 28 is to reduce inversion rollover during standing.

In one embodiment, the compression columns 24 had a diameter of about 5/16 inch and a height of about ¼ inch within the cavity 26 which had a depth of about ¼ inch and a diameter of about 2 inches. The columns are preferably arranged with a central column **24*a* and a series of columns 24 positioned on concentric circles about the central column 24*a***.

As shown in FIGS. 2 and 3, a raised heel cup 38 is provided in order to constrain the natural heel fat pad expansion during impact such as while walking or running and also advantageously to enhance the natural shock absorbing characteristics of the foot.

Figure 5:
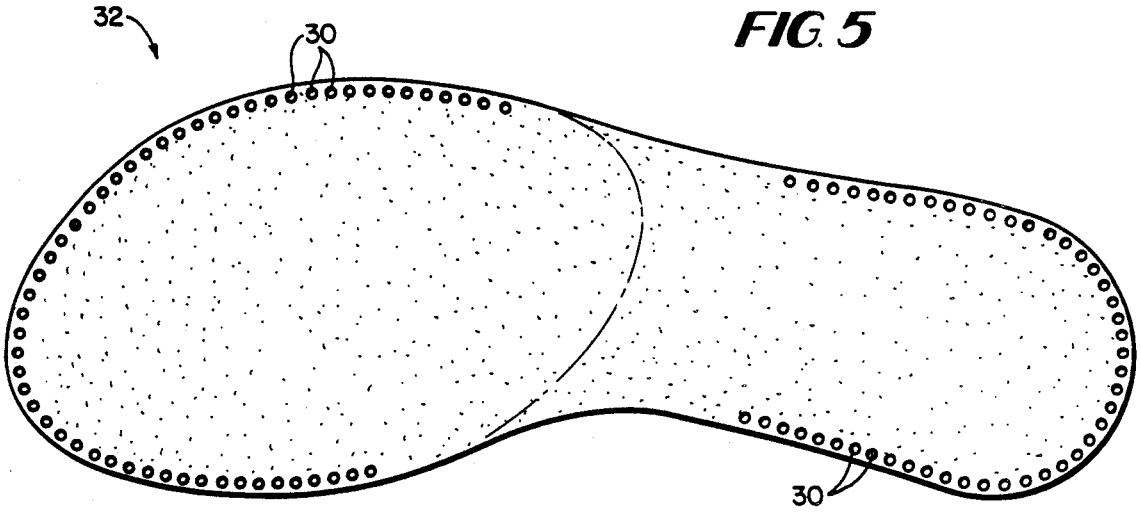
FIG. 5 is a plan view of an outsole of the present invention showing additional features.
Figure 6:
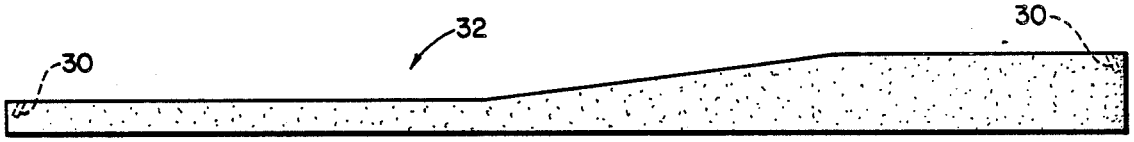
FIG. 6 is a side elevation of the outsole of FIG. 5.

In FIGS. 5 and 6 there is shown an embodiment of an outsole 32 of the present invention in which a plurality of reference anchor points in the form of small angled holes 30 are positioned around the periphery of the outsole 32 for use in anchoring the shoe upper into the outsole 32 so as to prevent early delamination. The holes 30 may be provided in the configuration as shown in FIG. 5 or incorporated as an additional feature in the embodiment of FIG. 1.

The angle of the holes 30 relative to the upper surface of the outsole 32 will generally be about 45 to 60 degrees. The diameter of the holes 30 will generally be about 1/16 to ⅛ inch while the depth of the holes 30 will depend on the modulus of the particular outsole material. The holes 30 should be of sufficient depth to provide sturdy anchoring points while being of sufficiently short length so as to leave enough outsole material beneath the holes 30 as to provide structural integrity for the outsole. In one embodiment, the depth of the anchor holes 30 was in the range of ⅛ to 3/16 inch.

As shown in FIG. 6, the outsole upper surface elevates from the forefoot or ball region of the foot to provide a height differential between the ball region and the heel region. In this manner, there is maintained the desired thinness of the forefoot region while providing a progressively thicker outsole in the midfoot and heel regions. In one embodiment the height differential was approximately ½ inch.

Figure 7:
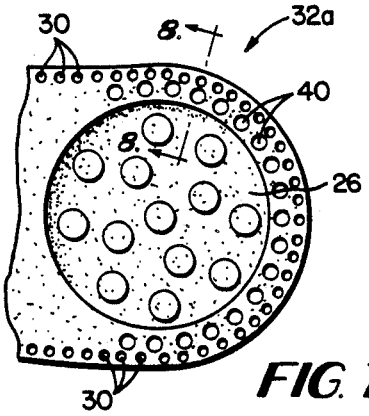
FIG. 7 is a plan view of an alternative embodiment of the heel region in the outsole of the present invention.
Figure 8:
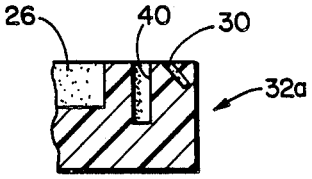
FIG. 8 is a cross sectional view taken along line 8—8 of FIG. 7.

In the embodiment as shown in FIGS. 7 and 8, the outsole **32*a* is provided with a series of holes 40 which assist in relief of the rear lateral heel border to dynamically smooth and cushion initial heel strike. These holes 40 are located between cavity 26 and anchor holes 30 and extend in a pattern around the posterior semicircular portion of the cavity 26. The diameter and depth of these holes 40, as well as the interval between adjacent holes 40**, will depend on the modulus of the particular outsole material.

Figure 9:
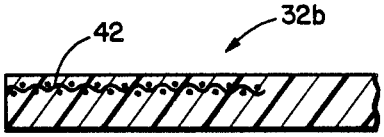
FIG. 9 is a cross sectional view of an alternative embodiment of the outsole of the present invention showing toe bed reinforcement by insert molding in the forefoot region.

As shown in FIG. 9, in an alternative embodiment, a stiffening member 42 such as a screen may be molded into the forefoot region of the outsole **32*b* under the toes. In this manner, toe bed reinforcement is provided by insert molding. The stiffening member 42 is positioned forward of the portion of the outsole which lies beneath the metatarsal heads. The stiffening member 42 is preferably formed of a material such that the compressive characteristics of the stiffening member 42** will be an order of magnitude (10 times or more) greater than that of the outsole material.

The sling straps 21, 23 employed with the embodiment of the monolithic outsole as shown in FIG. 2 could be any of various constructions, such as a flat strap of narrow width or a monofilament material with cushioning material underneath to protect the foot tissue. If the straps are too wide, however, they will tend to lift off the foot at certain points, thus creating excessive local pressures on the foot. Wide inextensible straps will have directionality problems and will cause local pressure points. Wide straps also take away from the ability to adjust the straps properly. As an example of a strap which may be employed in the present invention, a polyester ribbon strap having a width of about ⅜ inch and a modulus of about 525 pounds per inch per inch has been used with good results. At least five medial and five lateral straps of this type were employed in one embodiment and the overall contact area for Velcro fasteners employed on the ends of the straps was approximately 2½ square inches. In this embodiment, a polyurethane outsole having a thickness of about ½ inch in the ball region of the foot and a Shore A hardness of about 50 durometer was employed.

In one embodiment of the present invention, the construction and location of the sling straps is specified according to recognized anatomical landmarks. In this embodiment, the anterior lateral strap must be posterior to the fifth metatarsal head. Also, the posterior lateral strap should pass across the foot proximate and adjacent the calcaneal-cuboid joint. The anterior medial strap must remain posterior to the first metatarsal head in this embodiment. The posterior medial strap must be directed posteriorly, after passing proximate and adjacent the navicular protuberance. The medial and lateral slots are of sufficient length to allow the straps to attain these anatomical positions. One or more additional straps, as desired, are spaced between the anterior and posterior straps on each side of the outsole.

The closure device for the sling straps may be of any conventional type which is relatively inextensible so as to provide a small degree of looseness upon first tightening the straps with minimal or no load on the foot.

The strap geometry and specific mechanical properties can be varied as long as minimum strength and stiffness of the sling straps are maintained without introducing local pressures to the foot.

In one embodiment, the hoop which includes the medial and lateral straps and the portion of the outsole between the medial and lateral anchor points should not strain or elongate more than about 10% under body loads of the order of two to three body weights. Generally, the greatest strap loadings will occur during action such as intense running and such loadings would be carried during the gait cycle first by the rear straps and then would move forward during the midstance of the gait cycle. The act of standing would tend to distribute the loads more evenly.

The methods of maintaining the relative positions of the straps may be varied, for example, by bonds to the upper fabric and/or some additional scrim cloth.

The term "relatively inextensible" should be defined for the purposes of the present invention. Conventional shoe laces are typically woven structures in which fiber alignment provides that large strains must be produced before a significant load can be handled. One typical shoe lace strained 5% but carried a load of only five pounds. While a shoe lace has a continually increasing modulus, it is more beneficial, with regard to the present invention, for the support sling fibers to have a significant initial modulus which remains linear throughout the effective support range. Such a property allows significant forces to be supported at much lower strains. This is the inextensibility required for the support sling straps of the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An improved monolithic outsole formed as a homogeneous structure for mating with a shoe upper to provide a shoe construction, comprising:

an elongated planar member having the general outline of a foot with a heel region, a ball region and a midfoot region between said heel and ball regions, and with lateral and medial sides or borders and formed with a monolithic structure, said planar member having a plurality of parallel transverse slots located in the upper surface of said planar member in the midfoot region adjacent the lateral border and with said transverse slots being located outside the region of said outsole which is directly under the arch of the foot, said slots being generally perpendicular to the longitudinal axis of said planar member.

2. The monolithic outsole of claim 1 further including an array of small holes located in the ball region of said outsole, said holes extending across said outsole from the medial side to the lateral side.

3. The monolithic outsole of claim 2 wherein said holes in the ball region are arranged with the holes on the medial side of the outsole in at least one row parallel to the transverse metatarsal axis of the foot and with the holes on the lateral side of the outsole in at least one row parallel to the oblique metatarsal axis of the foot.

4. The monolithic outsole of claim 1 further including a lateral border chock in the form of a raised rib extending around the periphery of the heel region and along the lateral border of said planar member.

5. The monolithic outsole of claim 1 further including a plurality of compression columns arranged within a cavity in said heel region.

6. The monolithic outsole of claim 5 further including a plurality of holes positioned around the upper surface of the rear lateral heel border between said cavity in the heel region and the outer periphery of said heel region.

7. The monolithic outsole of claim 1 further including an arcuate medial slot and a linear lateral slot located in the upper surface of said planar member.

8. The monolithic outsole of claim 7 wherein said transverse slots do not extend medially beyond said arcuate medial slot.

9. The monolithic outsole of claim 7 further including at least one sling strap mounted in each of said arcuate medial slot and linear lateral slot.

10. The monolithic outsole of claim 7 wherein said arcuate medial slot is positioned so as to lie beneath three anatomical points of the foot, said points including the posterior edge of the first metatarsal head, the second or third cuneiform and the medial side of the calcaneus.

11. The monolithic outsole of claim 10 wherein said transverse slots do not extend medially beyond said arcuate medial slot.

12. The monolithic outsole of claim 10 further including at least one sling strap mounted in said arcuate medial slot.

13. The monolithic outsole of claim 12 wherein a plurality of sling straps are mounted in each of said arcuate medial slot and linear lateral slot, said sling straps including anterior and posterior straps mounted in the lateral slot and anterior and posterior straps mounted in the medial slot, said anterior lateral strap being positioned along the length of the shoe to overlie and pass posterior to the fifth metatarsal head of the foot, said posterior lateral strap being positioned along the length of the shoe to overlie and pass across the foot proximate and adjacent the calcaneal-cuboid joint of the foot, said anterior medial strap being positioned along the length of the shoe to overlie and be directed posterior to the first metatarsal head of the foot, and with said posterior medial strap being positioned along the length of the shoe to overlie and be directed posteriorly after passing proximate and adjacent the navicular protuberance of the foot.

14. The monolithic outsole of claim 7 wherein said linear lateral slot is positioned so as to lie beneath the anatomical portion of the foot which extends from beneath the posterior edge of the fifth metatarsal head to a point beneath the calcaneal-cuboid joint.

15. The monolithic outsole of claim 14 further including at least one sling strap mounted in said linear lateral slot.

16. The monolithic outsole of claim 15 wherein a plurality of sling straps are mounted in each of said arcuate medial slot and linear lateral slot, said sling straps including anterior and posterior straps mounted in the lateral slot and anterior and posterior straps mounted in the medial slot, said anterior lateral strap being positioned along the length of the shoe to overlie and pass posterior to the fifth metatarsal head of the foot, said posterior lateral strap being positioned along the length of the shoe to overlie and pass across the foot proximate and adjacent the calcaneal-cuboid joint of the foot, said anterior medial strap being positioned along the length of the shoe to overlie and be directed posterior to the first metatarsal head of the foot, and with said posterior medial strap being positioned along the length of the shoe to overlie and be directed posteriorly after passing proximate and adjacent the navicular protuberance of the foot.

17. The monolithic outsole of claim 1 further including a plurality of angled anchor holes positioned around the periphery of the outsole, said anchor holes being positioned at an angle of about 45 to 60 degrees relative to the upper surface of the outsole.

18. The monolithic outsole of claim 1 further including a stiffening member molded into the forefoot region of the outsole under the toes.

19. The monolithic outsole of claim 18 wherein the stiffening member is in the form of a screen formed of a material such that the compressive characteristics of the stiffening member are 10 times or more greater than that of the outsole material.

20. The monolithic outsole of claim 1 wherein said parallel transverse slots are of a length such that the slot of greatest length is located near the heel region and the slots are of successively reduced length in the anterior direction toward the forefoot region.

21. The monolithic outsole of claim 1 further including a raised heel cup in said heel region, with the outsole upper surface elevating from said ball region to said raised heel cup.

22. The monolithic outsole of claim 1 wherein said planar member is formed of a material having a modulus of about 2000 to 4000 pounds per inch per inch, with said modulus being reduced to a range of about 200 to 1000 pounds per inch per inch in the region of the transverse slots.

23. An improved monolithic outsole formed as a homogeneous structure for mating with a shoe upper to provide a shoe construction, comprising:

an elongated planar member having the general outline of a foot with a heel region, a ball region and a midfoot region between said heel and ball regions, and with lateral and medial sides or borders and formed with a uniform, monolithic structure, said planar member having an array of small holes located in the ball region of said outsole, said holes extending across said outsole from the medial side to the lateral side and wherein said holes in the bal region are arranged with the holes on the medial side of the outsole in at least one row parallel to the transverse metatarsal axis of the foot and with the holes on the lateral side of the outsole in at least one row parallel to the oblique metatarsal axis of the foot.

24. The monolithic outsole of claim 23 further including an arcuate medial slot and a linear lateral slot located in the upper surface of said planar member.

25. The monolithic outsole of claim 24 wherein said arcuate medial slot is positioned so as to lie beneath three anatomical points of the foot, said points including the posterior edge of the first metatarsal head, the second or third cuneiform and the medial side of the calcaneus.

26. The monolithic outsole of claim 25 further including at least one sling strap mounted in said arcuate medial slot.

27. The monolithic outsole of claim 24 wherein said linear lateral slot is positioned so as to lie beneath the anatomical portion of the foot which extends from beneath the posterior edge of the fifth metatarsal head to a point beneath the calcaneal-cuboid joint.

28. The monolithic outsole of claim 27 further including at least one sling strap mounted in said linear lateral slot.

29. The monolithic outsole of claim 24 further including at least one sling strap mounted in each of said arcuate medial slot and linear lateral slot.

30. The monolithic outsole of claim 24 wherein a plurality of sling straps are mounted in each of said arcuate medial slot and linear lateral slot, said sling straps including anterior and posterior straps mounted in the lateral slot and anterior and posterior straps mounted in the medial slot, said anterior lateral straps being positioned along the length of the shoe to overlie and pass posterior to the fifth metatarsal head of the foot, said posterior lateral strap being positioned along the length of the shoe to overlie and pass across the foot proximate and adjacent the calcaneal-cuboid joint of the foot, said anterior medial strap being positioned along the length of the shoe to overlie and be directed posterior to the first metatarsal head of the foot, and with said posterior medial strap being positioned along the length of the shoe to overlie and be directed posteriorly after passing proximate and adjacent the navicular protuberance of the foot.

31. The monolithic outsole of claim 23 wherein said planar member is formed of a material having a modulus of about 2000 to 4000 pounds per inch per inch.

32. The monolithic outsole of claim 23 wherein said planar member has a cavity in said heel region and a plurality of compression columns arranged within said cavity.

33. The monolithic outsole of claim 32 further including a plurality of holes positioned around the upper surface of the rear lateral heel border between said cavity in the heel region and the outer periphery of said heel region.

* * * * *